US005771735A

United States Patent [19]

Caporusso et al.

[11] Patent Number: 5,771,735

[45] Date of Patent: Jun. 30, 1998

[54] SUPPORT ARM ASSEMBLY FOR PIPE BENDING MACHINES WITH AUTOMATIC PIPE POSITIONING

[75] Inventors: Alessandro Caporusso; Marcio Caporusso, both of Frosinone, Italy

[73] Assignee: C.M.L. Costruzioni Meccaniche Liri S.r.l., Piedimonte San Germano, Italy

[21] Appl. No.: 789,530

[22] Filed: Jan. 27, 1997

[30] Foreign Application Priority Data

Jan. 25, 1996 [IT] Italy ..... RM96A0047

[51] Int. Cl.[6] ..... B21D 43/00

[52] U.S. Cl. ..... 72/307; 72/422

[58] Field of Search ..... 72/307, 311, 149, 72/153, 422

[56] References Cited

U.S. PATENT DOCUMENTS

| | | | |
|---|---|---|---|
| 3,885,410 | 5/1975 | Kopczynski | 72/307 |
| 4,331,016 | 5/1982 | Benteler | 72/307 |
| 4,485,658 | 12/1984 | Stewart | 72/307 |

FOREIGN PATENT DOCUMENTS

| | | |
|---|---|---|
| 0 227 429 | 7/1987 | European Pat. Off. . |
| 30 19 111 | 11/1981 | Germany . |
| WO 94 27757 | 12/1994 | WIPO . |

*Primary Examiner*—Daniel C. Crane
*Attorney, Agent, or Firm*—Young & Thompson

[57] ABSTRACT

A support arm assembly for a pipe bending machine, including one or more linear ledges arranged along the arm; a mandrel including a piece for intercepting the ledges through a click (106) switching between a raised rest position and a lowered working position by the displacement of an eyelet, in which it can slide, having raising edges (105) against which click (106) is loaded, under the actuation of an air cylinder, under the control of means that also control the opening/closing of the pipe carrier gripper (16) of the mandrel; and angular ledge dowels with a sense cut (200) being provided on the periphery of the mandrel, cooperating with a spring-loaded locator.

2 Claims, 4 Drawing Sheets

SUPPORT ARM ASSEMBLY FOR PIPE BENDING MACHINES WITH AUTOMATIC PIPE POSITIONING

The present invention relates to a support arm assembly for pipe bending machines.

As is known, the support arms for pipe bending machines are those assemblies, to be associated with a pipe bending machine, for supporting and positioning a pipe during a bending operation. The positioning function is performed by a mandrel that slides positionally on the support arm.

In the pipe bending machines presently in use, the operator has to leave the command area to open and close the mandrel of the support arm. Positioning ledges are inserted and disinserted manually with a shaft with ledges adjustable through handles sited in the command area. A manual, not an automatic operation is so dealt with.

Sophisticated numeric control machines presently on the market are able to automatically perform the aforementioned function, but with expensive electronic and mechanical systems, for instance by means of hydraulic, electromechanical controls and electronic servos.

The object of the present invention is to provide a pipe bending machine that allows the positioning function to be performed automatically, but that is inexpensive at the same time.

Therefore, the present invention relates to a support arm assembly for a pipe bending machine, with a pipe positioning mandrel slidable on it, endowed with a pipe carrier gripper, including one or more linear ledges arranged along the arm; the mandrel including a piece for intercepting the ledges through a click switched between a raised rest position and a lowered working position by the displacement of an eyelet; wherein it can slide, having raised edges where-against the click is loaded, under the actuation of a piston; a single hydraulic or air drive contemporaneously actuating the opening/closing of the pipe carrier gripper and the switching of the click.

Moreover, the present invention relates to such a support arm assembly for a pipe bending machine, wherein the mandrel further comprises reversible angular ledge dowels with an angled cut, provided on the periphery of the mandrel, cooperating with a spring-loaded locator pin, said locator pin being able to be inserted/disinserted for right or left curves through a spindle with a cut extremity actuated by a lever mechanism controlled by ledge contrasts arranged on a linear guide.

The present invention will be best understood based upon the following detailed disclosure of a preferred embodiment thereof, given only as a matter of example, absolutely not of restriction, with reference to the accompanying drawings wherein.

The assembly that constitutes the subject-matter of the present invention, therefore, includes a support arm, to be mounted with an extremity aside a pipe bending machine and a core shaft-carrier mandrel, slidingly mounted on the arm.

Figure 1:
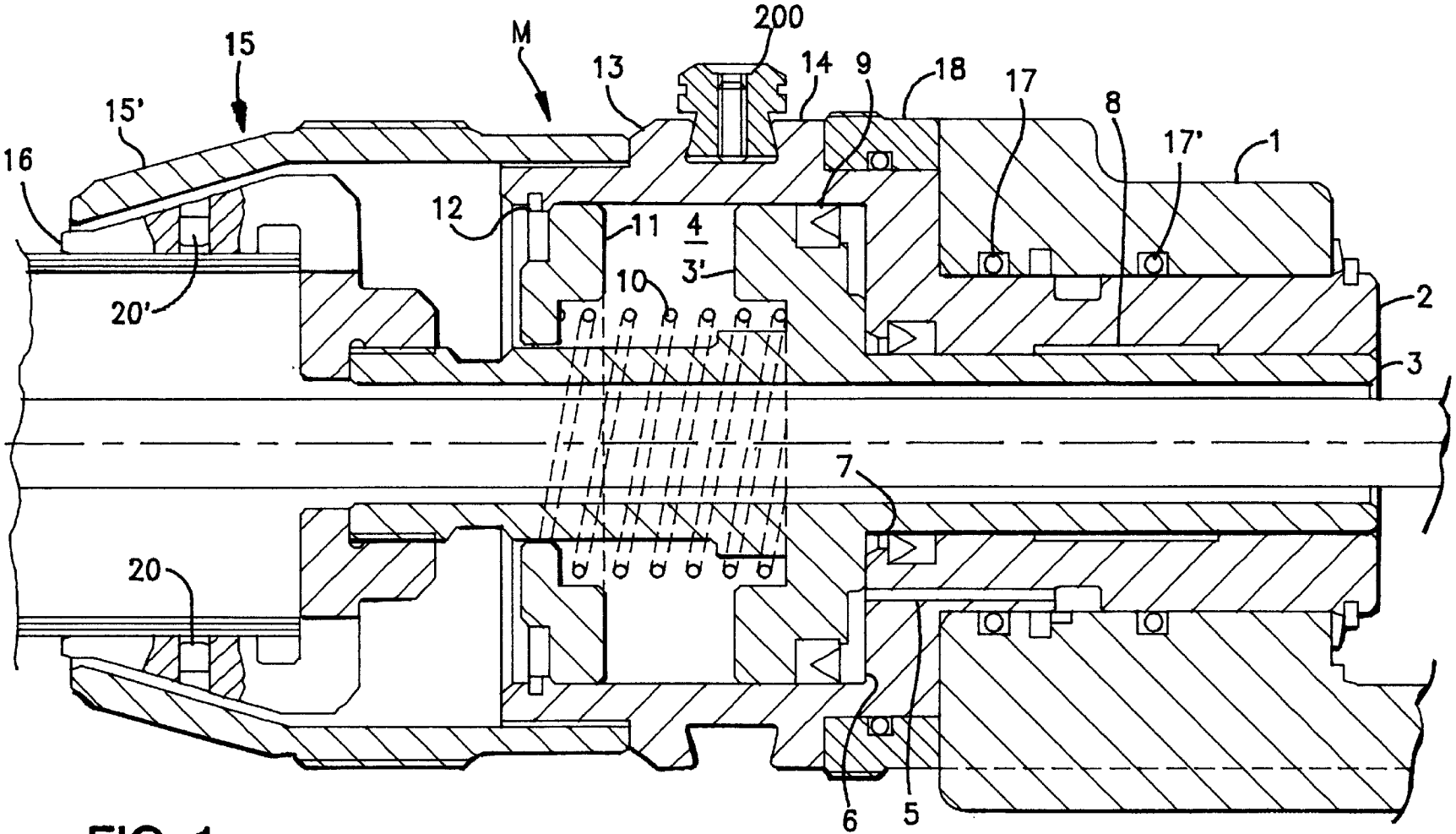
FIG. 1 is a longitudinal section view of the core shaft-carrier mandrel of the assembly, in a closed state.

As can be observed in FIG. 1, the core shaft-carrier mandrel M comprises a support sleeve jacket 1 that supports the working elements of the mandrel. Basically, the working portion is an air cylinder comprising a cylinder 2 that has two sections, one with a lesser diameter, housed and supported in said jacket 1, and the other one with a greater diameter, that enlarges in correspondence with an end section of the jacket 1, otherwise it also being enlarged as a flange. In such a cylinder 2, the relevant piston 3 is mounted, inside which the core shaft slides. The greater diameter portion of the cylinder 2 defines a chamber 4 wherein the head 3' of piston 3 slides, while the stem of the piston 3 is supported by the lesser diameter section of the cylinder 2. The air for the actuation of the piston 3 is let in through a (not shown) manifold to a small hole 5 in direct air communication with the chamber between the rear portion of the piston head 3' that has a ledge section, and the cylinder body. The rear of the piston head 3' presents a forward staggered geometry that opens a chamber 6 in its state of abutment against the cylinder 2, in the position of full backward displacement. The cylinder 2, on its side, presents a backward staggered geometry which opens a corresponding chamber 7. The abutment between the cylinder 2 and the head 3' of the piston, therefore, takes place in correspondence with two end steps. In chamber 7 a gasket is arranged for the stem of the piston. In the lesser radius section of the cylinder 2, a full-circumference recess 8 is made, to be filled with grease, so as to make up a lubrified air space for good sliding of the stem of the piston 3.

In the front step of head 3' a gasket 9 is arranged for sliding of the head of the piston 3 in the greater diameter section of the cylinder 2.

Between the support jacket 1 and the cylinder 2, two seal toroidal rings, or O-rings, 17, 17' are arranged, intended to avoid air outflow from the mandrel.

The front of the head 3' of the piston presents a flared geometry affording a recess for supporting one end of a helicoidal compression spring 10 that is supported at its other end by a support ring 11. The spring 10 is also slidable, like the piston head, in cylinder 2. A ring 12 mounted in cylinder 2 near the end section prevents the support ring 11 from popping out of the body of the mandrel.

The greater diameter section of the cylinder 2 presents two continuous ridges 13, 14, that extend about the periphery of the cylinder 2. The ridge 13 is a front abutment and the ridge 14 is a rear abutment. Beyond the ridge 13 the cylinder projects with a conspicuous overhang. On this overhang a knurled ring nut 15 is fitted. The nut 15 has a first cylinder portion that fits over the cylinders 2 and extends thereafter as an overhang, and a second narrowing taper 15'. A pipe carrier gripper 16 with four (4) interchangeable clamps, for instance in teflon or in brass, is mounted in the nut 15.

The piston 3 continues, beyond head 3', inside spring 10, with a substantial projection from the cylinder 2, within ring nut 15, passing thereafter within ring 11. At its free extremity it supports gripper 16, actuating the opening/closing thereof on the core shaft.

The disclosed construction represents a single-acting cylinder. The piston 3 is displaced by action of the air, thereby closing the gripper 16. When the air pressure is released the compression spring returns the piston to a rest position so that the gripper is thereby opened. The operation is controlled through a keyboard with a GRIPPER CLOSE button where an electrovalve is operated that controls pressure feed/release from the air cylinder.

The other circular ridge 14, together with the end section of the support jacket 1 which it faces, provides a space wherein a turnable ring nut 18 is arranged. Nut 18 relates to the angular positioning of the mandrel, and is slightly frictioned through a toroidal ring. On the ring nut 18 a 360° graduation system is impressed.

Figure 3:
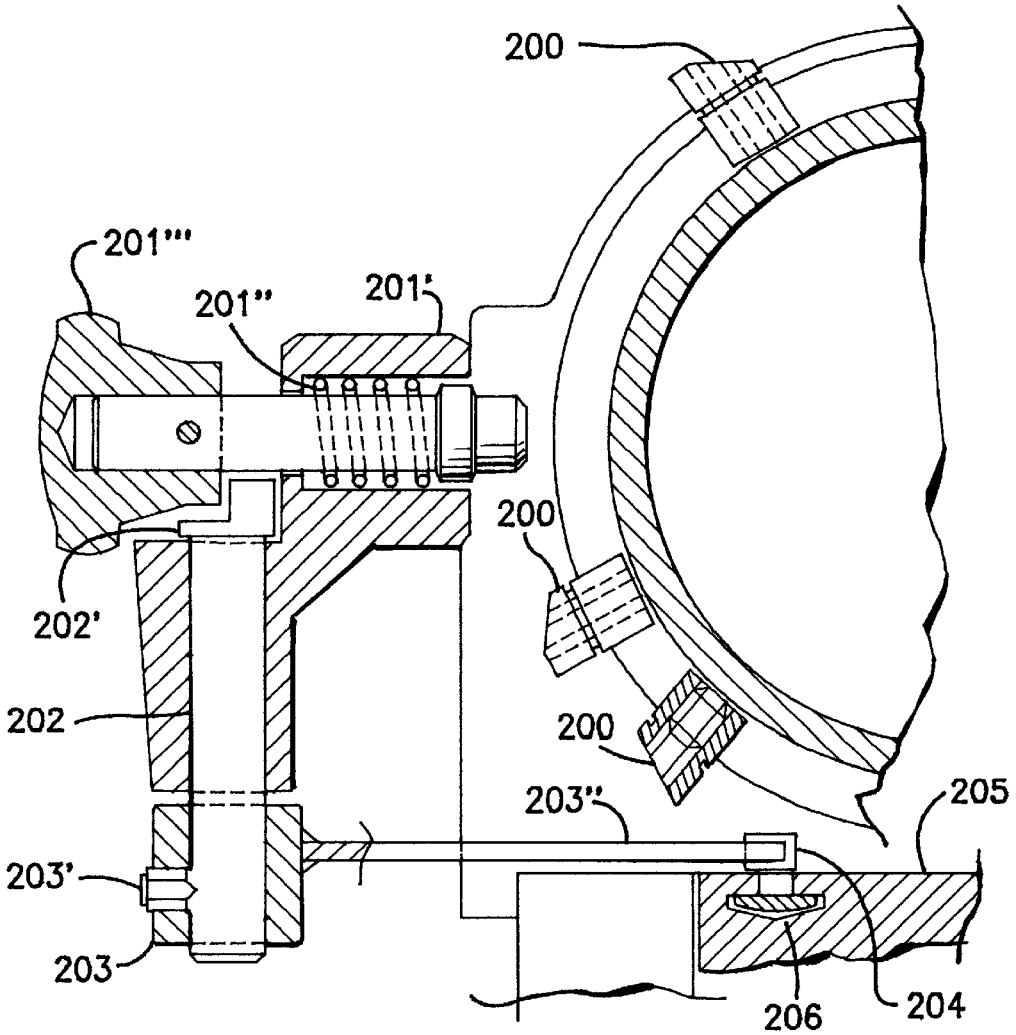
FIG. 3 is a view that illustrates the angular ledges of the mandrel.
Figure 3:
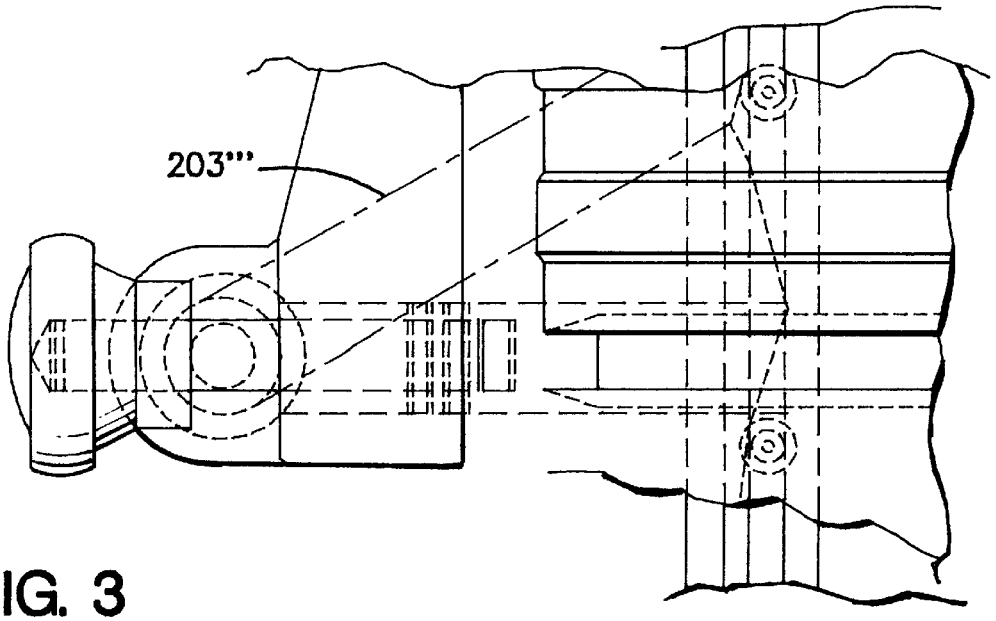

With reference now to FIG. 3, cylinder 2, between the two continuous ridges 13 and 14, presents a continuous slot for receiving positionable dowels 200 that are adjustable angular ledges cooperating with a spring-loaded locator 201 integral with the mandrel. The dowels have their head cut directionally—and they are reversible—for the sense of the curve to be impressed to the pipe. For right and left rotation curves, the dowels are positioned with the portion cut in such a way as to be able to carry out the rotation. The locator 201 is arranged horizontally, by a side of the mandrel, whereto it is integrally mounted, through a support 201'. The locator 201 is loaded by a helicoidal compression spring 201", housed within the support 201', to a lowered position, in which the locator engages the heads of the dowels 200, stopping the rotation of the mandrel when it encounters the flat face (opposite the angled face) of the dowels 200. The support 201' houses a small cylinder 202 with a cut overhanging end 202' which receives the handle 201"' of the locator 201, but which pushes the same away from the flat face of the dowel 200. In this way it acts as a command for the switching of the locator 201 between the lowered/raised positions. The small cylinder 202 is maneuvered with the following construction. It is threaded through a bush 203 to which it is connected through a pin 203'. Bush 203 is at the extremity of a lever 203", rotating horizontally, which with its other extremity can engage linear abutting platelets 204 having an overhanging head and a fixing body 206 in a guide 205.

To actuate the mechanism it suffices to displace the mandrel on the guide 205, by displacing its carriage. The lever 203" encounters the head 204 and so it is rotated, dragging the small cylinder 202. The cut milling displaces the handle 201"', so raising the locator overcoming the spring that loads the latter. The mandrel is so free to rotate.

The grippers 16 are endowed with through-dowels 20, 20', that can be adjusted by screwing to be able to operate on irregular section pieces.

The mandrel is mounted on a support and guide arm, not shown, that is associated by a side of the pipe bending machine with which it has to cooperate.

Figure 2:
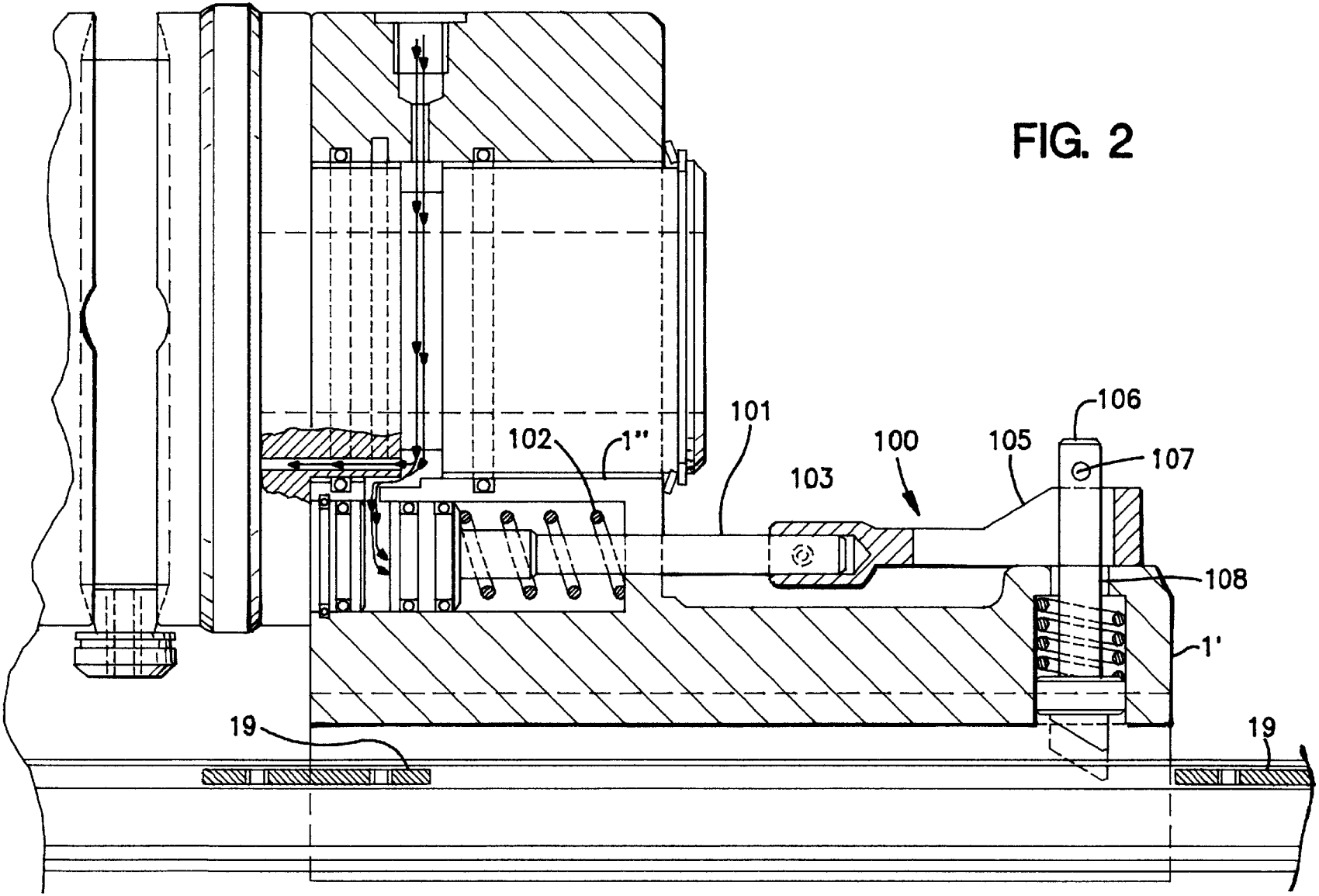
FIG. 2 is a view that illustrates a click piece used for the linear positioning of the mandrel in cooperation with ledges provided on the assembly arm.

With reference to FIG. 2, along the arm platelets 19 are arranged that fix linear ledges defining as many working positions. The interception of these guide positions is affected through a click interception piece 100 mounted on the mandrel disclosed above.

The interception piece 100 includes a support 1' depending from the support jacket 1 of the mandrel. In the mandrel a second air cylinder 1" is housed, actuated by the same air source as the cylinder of the mandrel. It includes a stem 101 loaded to a backward rest position by a compression spring 102 housed in the cylinder 1" that has two ends respectively on a flanged head of the cylinder 1" and on an end narrowing circular closing section of the cylinder. The stem 101 projects very much out of the cylinder 1", extending on and along the support 1'. Its free extremity is inserted into an eyelet 103 that includes a support tract that by a side presents a recess for a dowel for holding the stem 101, so as to render the same integral thereto. Piece 100 includes a rectilinear through hollow 104 developed longitudinally, limited on its sides by edges that present a raising edge 105 centered relative to the longitudinal development of the through hollow. In this hollow a click 106 abuts the interception piece 100. Click 106 includes a pin 107 that rests on two extremities projecting in diametrically opposite positions on the raising edges 105 of the piece 100. The click 106 is mounted in a horizontally fixed position in a hollow 108 of the support 1' wherein it is loaded toward the bottom through a helicoidal compression spring. It is apparent that with this construction the click 106 is bound to follow the profile of the raising edges 105 then to raise/lower itself with the displacement of the eyelet piece 103 under the actuation of the relevant air cylinder above. The click 106 is actuated by an air cylinder actuated by the same control of the opening/closing of the pipe carrier gripper 16. That is, as mentioned above, the source of air for the two cylinders is the same.

Figure 4:
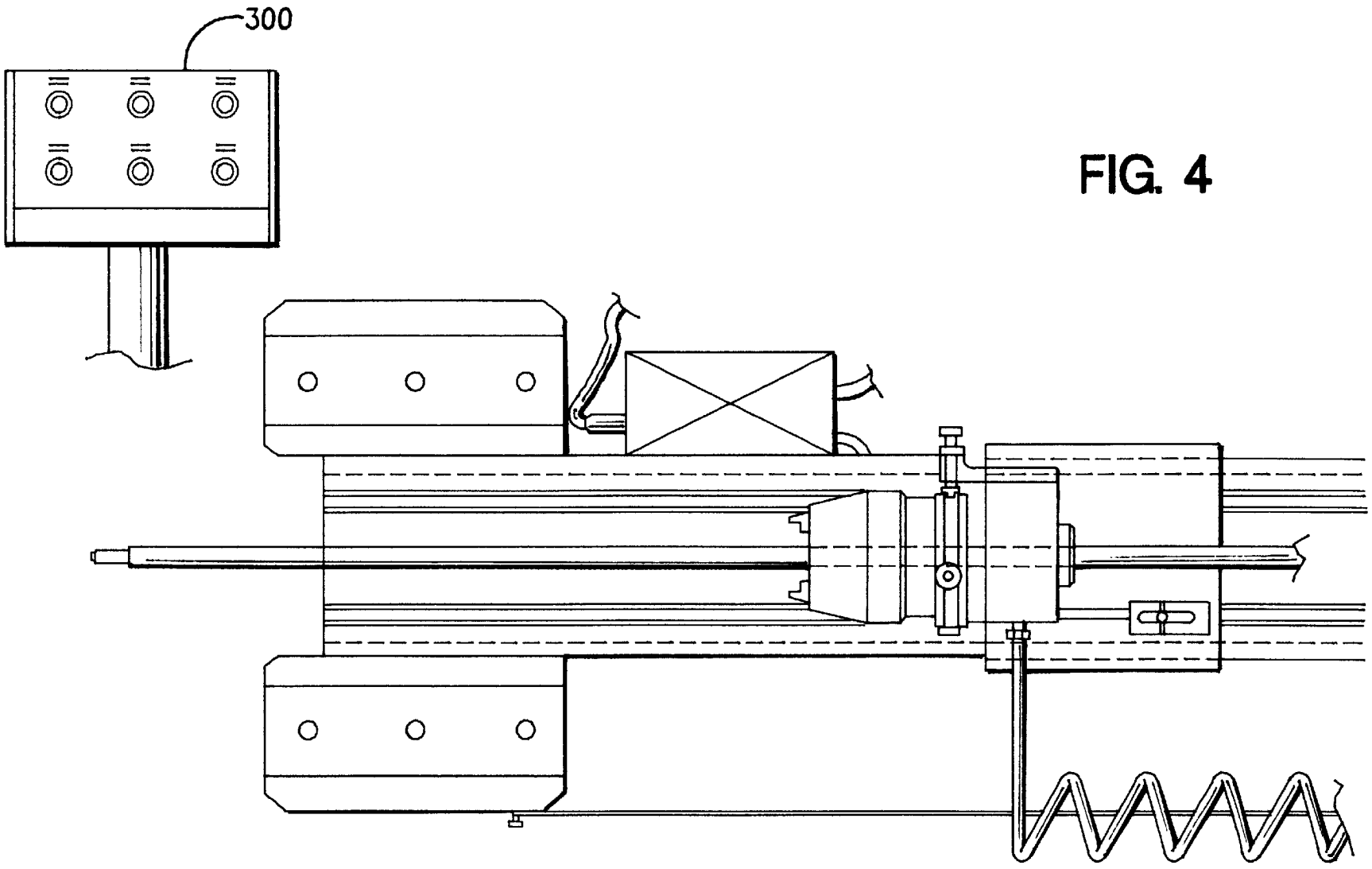
FIG. 4 is a top assembly view of the core arm of the present invention with the mandrel mounted.

FIG. 4 shows the whole of the described core arm assembly with indicated the control keyboard 300.

The present invention has been described and illustrated with reference to a specific embodiment thereof, but it is to be understood that variations can be made without departing from the relevant scope of protection.

We claim:

1. A support arm assembly for a pipe bending machine, with a support arm, a mandrel (M) for positioning a pipe slideable on the support arm, and a pipe carrier gripper (16), comprising:

one or more linear ledges (19) arranged along the support arm;

the mandrel (M) including a piece (100) for intercepting said ledges (19) through a click (106) switched between a raised rest position and a lowered working position by the displacement of an eyelet, in which the click (106) slides and which has raising edges (105) against which the click is loaded under the actuation of a piston; and a single hydraulic or air drive or actuator contemporaneously actuating the pipe carrier gripper (16) and the switching of the click (106).

2. The support arm assembly for a pipe bending machine according to claim 1, wherein the mandrel (M) further comprises reversible angular ledge dowels (200) with one angled face, a spring loaded locator (201) cooperating with said dowels, a spindle (202) with a cut extremity (202') actuated by a lever mechanism (203") controlled by abutment platelets (204) arranged on a linear guide (205), said spindle (202) removably inserting said locator (201) to control a pipe bending direction.

* * * * *